US010791810B2

(12) United States Patent
Maltais et al.

(10) Patent No.: US 10,791,810 B2
(45) Date of Patent: Oct. 6, 2020

(54) HANDLE AND METHOD OF DEPLOYING A HANDLE

(71) Applicant: CHARLES SIMON INC., Montreal (CA)

(72) Inventors: Simon Maltais, Montreal (CA); Charles Girard-Tremblay, Montreal (CA); Sébastien Bérubé, Montreal (CA); Pascal Godin, Montreal (CA); Nicolas Simard-Auger, Mascouche (CA); Émile Jodoin, Montreal (CA)

(73) Assignee: CHARLES SIMON INC., Montreal (CA)

( * ) Notice: Subject to any disclaimer, the term of this patent is extended or adjusted under 35 U.S.C. 154(b) by 0 days.

(21) Appl. No.: 16/379,957

(22) Filed: Apr. 10, 2019

(65) Prior Publication Data

US 2019/0313757 A1 Oct. 17, 2019

(30) Foreign Application Priority Data

Apr. 13, 2018 (FR) ..... 18 53262

(51) Int. Cl.
*A45C 13/22* (2006.01)

(52) U.S. Cl.
CPC ..... *A45C 13/22* (2013.01); *A45C 2013/226* (2013.01)

(58) Field of Classification Search
CPC ... A45C 13/22; A45C 2013/226; A45C 13/26; A45C 2013/267
USPC ..... 16/405, 429
See application file for complete search history.

(56) References Cited

U.S. PATENT DOCUMENTS 1,495,752 A * 5/1924 La Rue ..... A45C 13/22 16/405
2,314,799 A * 3/1943 Piker ..... A45C 13/26 16/405
3,372,780 A * 3/1968 Fujioka ..... A45C 13/26 16/405
3,388,416 A * 6/1968 Szabo ..... H04N 5/64 16/405
3,418,681 A * 12/1968 Szabo ..... A45C 13/22 16/405
3,426,384 A * 2/1969 Marton ..... B65D 25/2826 16/405

(Continued)

FOREIGN PATENT DOCUMENTS

GB 623672 A 5/1949

OTHER PUBLICATIONS

CA178412 office action dated Aug. 24, 2018.

(Continued)

*Primary Examiner* — Jeffrey O'Brien
(74) *Attorney, Agent, or Firm* — Anglehart et al.

(57) ABSTRACT

A retractable handle. It has a first arm comprising a first end and a second end and a second arm comprising a first end and a second end; a gripping segment that interconnects the first arm at the first end of the first arm and the second arm at the first end of the second arm, wherein the first arm is attached to the gripping segment such that the first arm can rotate about the attachment point of the first arm to the gripping segment, and wherein the second arm is attached to the gripping segment such that the second arm can rotate about the attachment point of the second arm to the gripping segment; and an attachment for securing the handle to a luggage body.

12 Claims, 9 Drawing Sheets

(56) References Cited

U.S. PATENT DOCUMENTS 3,431,586 A * 3/1969 Bush ..... A45C 13/26 16/405
3,438,467 A * 4/1969 Milette ..... A45C 13/26 16/405
3,447,195 A * 6/1969 Bush ..... A45C 13/22 16/405
3,447,197 A * 6/1969 Marton ..... A45C 13/26 16/405
3,699,612 A * 10/1972 Hanley ..... A47B 95/02 16/405
3,795,941 A * 3/1974 Szabo ..... A45C 13/26 16/405
3,808,634 A * 5/1974 Szabo ..... A47B 95/02 16/405
3,988,802 A * 11/1976 Bruni ..... H05K 5/023 16/429
4,066,155 A * 1/1978 Buchek ..... A45C 5/00 190/115
5,075,926 A * 12/1991 Jeong ..... A45C 13/22 16/429
6,017,106 A * 1/2000 Adams ..... A45C 13/22 312/223.2
6,032,334 A * 3/2000 Iima ..... A45C 13/22 16/405
6,389,645 B1 * 5/2002 Polidoro ..... A45C 13/26 16/405
6,426,876 B1 * 7/2002 Shearman ..... H05K 5/023 211/17
7,936,562 B2 * 5/2011 Nagamura ..... G06F 1/1616 16/429
8,453,297 B2 * 6/2013 Wang ..... G06F 1/1616 16/114.1
10,606,311 B2 * 3/2020 Shindo ..... G06F 1/1637
2019/0350352 A1 * 11/2019 Chou ..... A45C 13/26

OTHER PUBLICATIONS

CA178412 office action dated Jan. 22, 2019.
CA178412 office action dated Apr. 11, 2019.
FR application 1853262 search report dated Nov. 12, 2018.
FR application 1853262 written opinion dated Nov. 12, 2018.

* cited by examiner

HANDLE AND METHOD OF DEPLOYING A HANDLE

The present patent application claims priority from French patent application No. 18/53262 filed on Apr. 13, 2018.

TECHNICAL FIELD

The present application relates to handles, and more specifically handles for luggage.

BACKGROUND

Handles for luggage risk damage due to the luggage being occasionally tossed and shuffled around during transportation. The protruding handle also risks snagging on neighboring objects, further damaging the handle or causing damage. Therefore, it would be advantageous to have a handle that can retreat into the body of the luggage, avoiding damage.

Certain retractable handles for luggage are known. One example is a handle that can travel vertically, the user either pulling the handle out or pushing the handle back in. Other retractable handle mechanisms for deploying and retracting a handle would be advantageous, particularly those that take up less space in the body of the luggage.

SUMMARY

The present disclosure relates to a handle retractable within cavity defined in a body of an object, such as the body of luggage, and that can be deployed by having the arms undergo a rotary or pivot motion, the handle swinging out of the cavity into which it has been receded such that the handle is deployed and can be grasped.

The handle is dimensioned such that it may retract into the luggage while having a width that, when retracted and collapsed, takes up a minimum amount of space.

A first broad aspect is a retractable handle. The retractable handle includes a first arm comprising a first end and a second end and a second arm comprising a first end and a second end. The handle includes a gripping segment that interconnects the first arm at the first end of the first arm and the second arm at the first end of the second arm, wherein the first arm is attached to the gripping segment such that the first arm can rotate about the attachment point of the first arm to the gripping segment, and wherein the second arm is attached to the gripping segment such that the second arm can rotate about the attachment point of the second arm to the gripping segment. The handle includes an attachment for securing the handle to a luggage body. The handle, through rotary motion of the first arm and the second arm, is adapted to transition between a deployed state and a retracted state, wherein a length of the first arm, a length of the second arm and a length of the gripping segment are parallel in the retracted state, and wherein the length of the first arm is parallel to the length of the second arm in the deployed state, and the length of the first arm is orthogonal to the length of the gripping segment in the deployed state.

In some embodiments, the attachment may include an elongated casing to which is connected the second end of the first arm at a first casing attachment point and the second end of the second arm at a second casing attachment point. The casing may include a cavity with a length sufficient to receive both the length of the first arm and the length of the second arm, the cavity further adapted to receive the gripping segment, the elongated casing attachable to the luggage body. The first arm may be configured to undergo rotary motion about the first casing attachment point and the second arm is configured to undergo rotary motion about the second casing attachment point. The gripping segment, the first arm and the second arm may be retractable into the cavity by the rotating of the first arm and the second arm, and the first arm and the second arm are deployable from the cavity by the rotating of the first arm and the second arm.

In some embodiments, the first arm and the second arm may be configured to maintain a parallel configuration when rotating.

In some embodiments, the first arm may be attached to a first end of the gripping segment at a top portion of the gripping segment, and the second arm may be attached to a second end of the gripping segment at a bottom portion of the gripping segment, where the first end of the first arm may provide a surface configured to abut with a side surface of the gripping segment facing the abutting surface of the first arm when the handle is deployed.

In some embodiments, the gripping segment may include at the second end a flat-faced end plate fixed to the second arm.

In some embodiments, the rotating of the first arm and the second arm may be driven by an actuator comprising a shaft that is connected to the second end of the first arm.

In some embodiments, the actuator may be a torsion spring mechanism.

In some embodiments, the elongated casing may include a rail groove positioned next to one of the first casing attachment point and the second casing attachment point, where the rail groove may be shaped to receive a pin connected to one of the first arm and the second arm, the pin travelling through the rail groove as the handle transitions between being retracted and being deployed, the pin abutting the ends of the rail groove in order to control the magnitude of movement of the first and the second arm when transitioning between the retracted state and the deployed state.

In some embodiments, the handle may include a latch configured to secure the handle in the retracted state.

In some embodiments, the handle may include a latch configured to secure the handle in the deployed state.

In some embodiments, the handle may include a latch configured to secure the handle in the retracted state and a latch configured to secure the handle in the deployed state. The first arm may include a projection protruding towards the second arm when the length of the first arm is parallel with the length of the second arm. The latch configured to secure the handle in the retracted state may be configured to engage with the projection to secure the handle in the retracted state, and wherein the latch configured to secure the handle in the deployed state may be configured to engage with the projection to secure the handle in the deployed state.

In some embodiments, the latch configured to secure the handle in the deployed state may include a depressible button, an unlocking segment connected to the depressible button that undergoes a downward displacement when the depressible button is depressed, and a lever that is configured to rotate when the unlocking segment presses down on an arm of the lever as the unlocking segment undergoes the downward displacement, where the lever further may be configured to engage with the projection to secure the handle in the deployed state, and wherein rotating of the lever may result in the lever disengaging with the projection.

In some embodiments, the gripping segment may include a prism body.

In some embodiments, the rectangular faces of the prism body may include rounded edges.

In some embodiments, the gripping segment may rest on top of the second arm when the handle is in the retracted state.

Another broad aspect is luggage including a handle as defined herein.

Another broad aspect is a system for locking a handle that is adapted to swing in and out of a cavity defined within a body of a luggage, the handle including a first arm, a second arm, and a gripping segment interconnecting the first arm at a first articulation at a first end of the first arm and the second arm at a second articulation at a first end of the second arm. The system includes a first projection connected to the first arm that is positioned to be received within an inner compartment of the gripping segment. The system includes a depressible button positioned on the gripping segment that is adapted to undergo a translational downward movement when pressure is applied to the depressible button by a user. The system includes an unlocking segment positioned in the cavity of the gripping segment connected to the depressible button that undergoes the translational downward movement with the depressible button. The system includes an abutting portion that is adapted to abut against the first projection when the unlocking segment has not undergone a translational downward movement, the abutting of the abutting portion against the first projection restricting movement of the first arm with respect to the gripping segment. The unlocking segment having undergone the translational downward movement along with the depressible button displaces the abutting portion such that the first arm is free to rotate with respect to the gripping segment, the displaced abutting portion no longer acts as a barrier to the first projection connected to the first arm.

BRIEF DESCRIPTION OF THE DRAWINGS

The invention will be better understood by way of the following detailed description of embodiments of the invention with reference to the appended drawings, in which.

DETAILED DESCRIPTION

In the present application, by "luggage" it is meant a hollow body for containing personal belongings that can be carried, dragged or wheeled around, such as a suitcase, a briefcase, a travel bag, a laptop case, a trunk, etc.

In the present disclosure, reference is made to the exemplary use of the handle for luggage. However, it will be understood that the handle may be used for other applications, such as a car door, a desk drawer, a safe door, a tool box, a lunch box, etc.

Figure 1B:
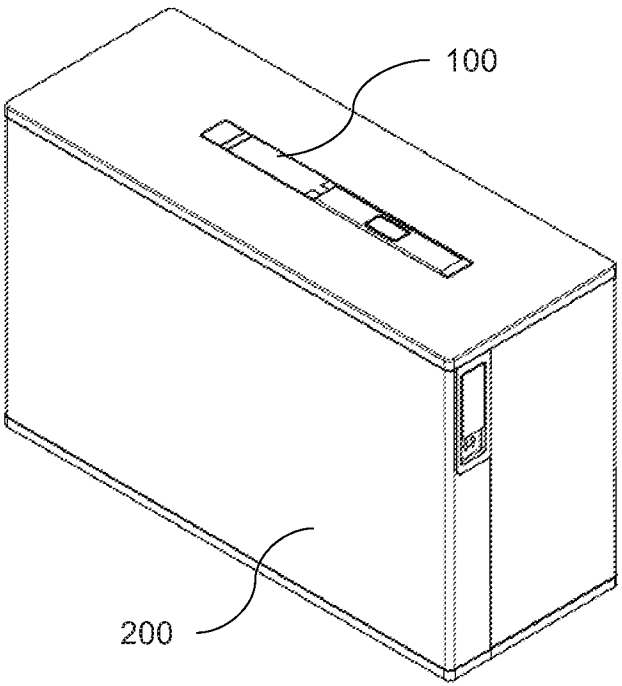
FIG. 1B is a drawing of a perspective view of exemplary luggage having an exemplary retractable handle, the retractable handle in a retracted state.
Figure 1A:
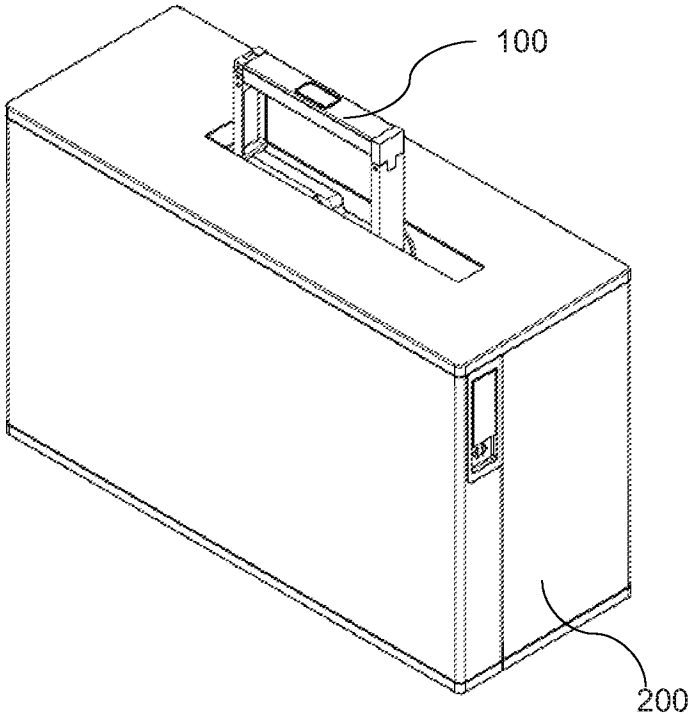
FIG. 1A is a drawing of a perspective view of exemplary luggage having an exemplary retractable handle, the retractable handle in a deployed state.

Reference is made to FIGS. 1A and 1B, illustrating an exemplary luggage 200 with an exemplary handle 100. FIG. 1A shows the handle 100 deployed, where FIG. 1B shows the handle retracted into the luggage 200. As illustrated in FIG. 1B, once retracted into the luggage 200, the handle 100 is flush with the surface of the luggage 200.

Figure 2A:
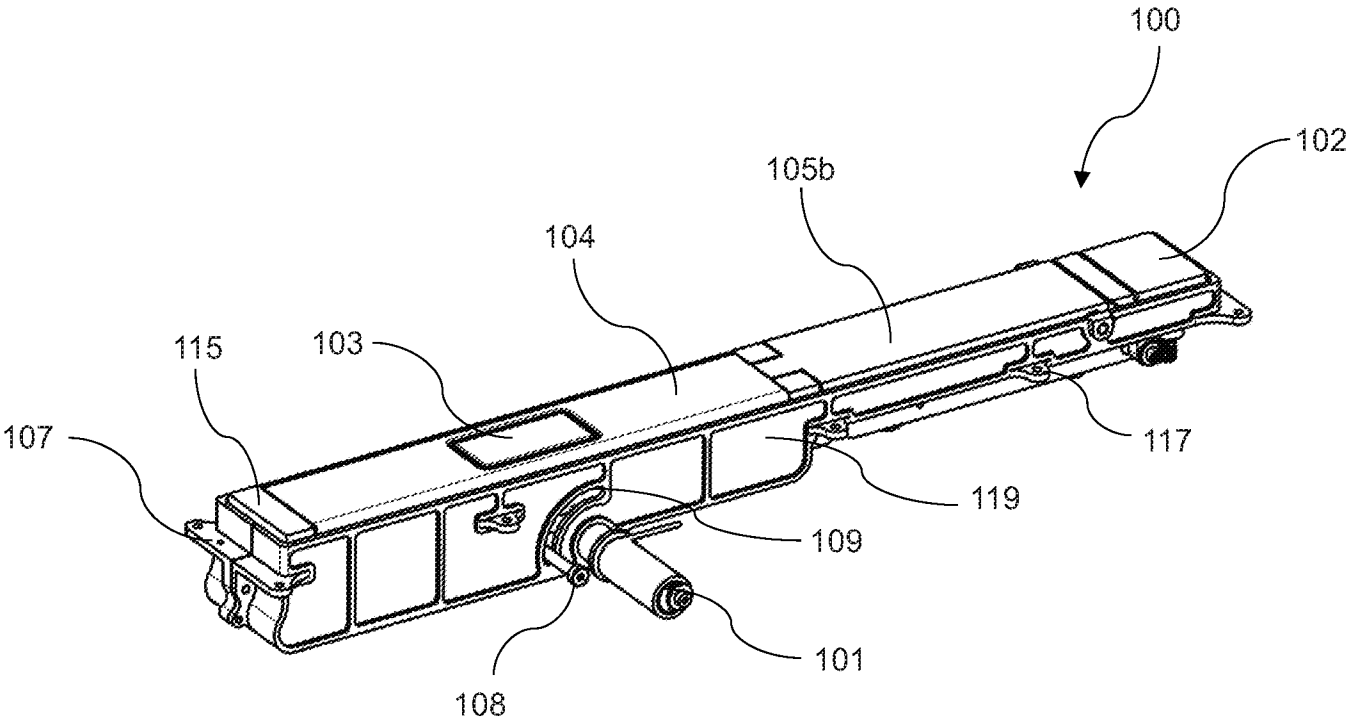
FIG. 2A is a drawing of a perspective view of an exemplary retractable handle, the retractable handle in a retracted state.
Figure 2B:
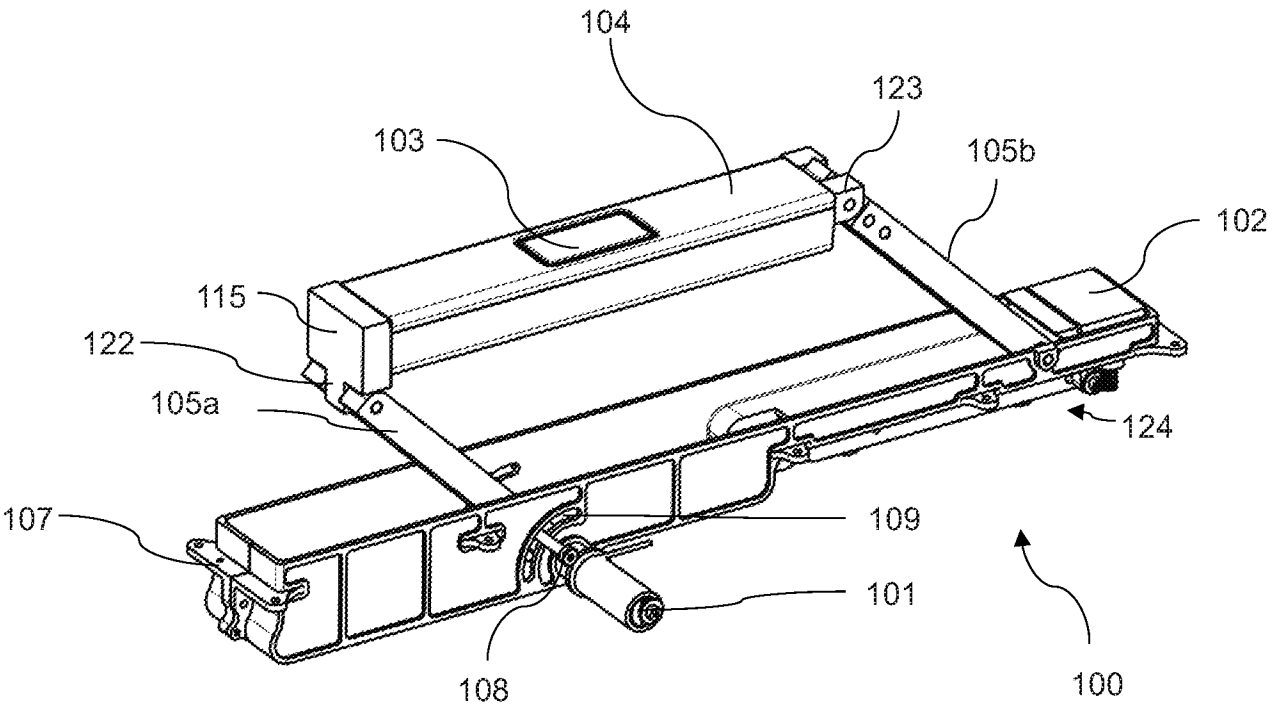
FIG. 2B is a drawing of a perspective view of an exemplary retractable handle transitioning between a retracted state and a deployed state.
Figure 2C:
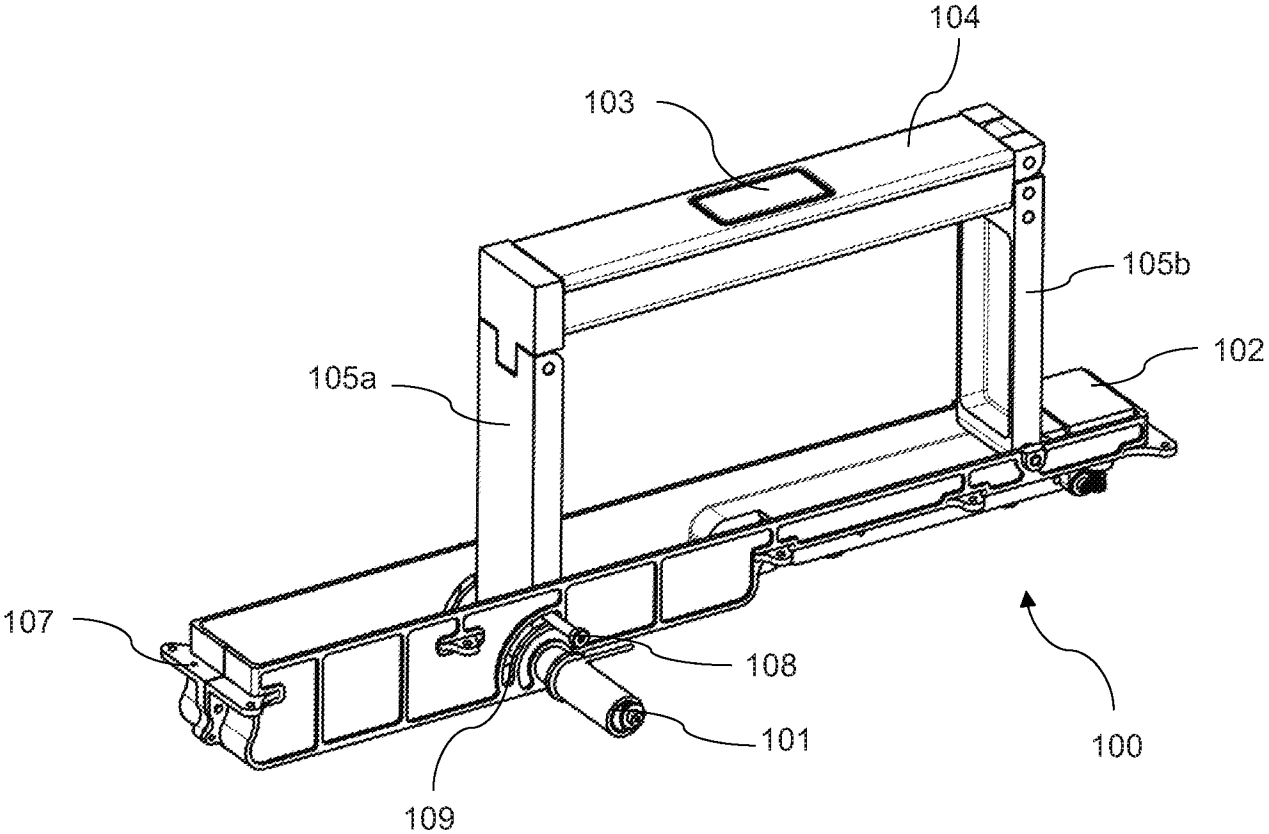
FIG. 2C is a drawing of a perspective view of an exemplary retractable handle, the retractable handle in a deployed state.

The Handle:

Reference is now made to FIGS. 2A to 2C, illustrating different positions of an exemplary handle 100.

The handle 100 is attached or attachable to the luggage 200 using one or more attachments. Such attachments may be, for instance, one or more pins, bolts, screws, a glue or adhesive, rivets, etc. In some embodiments, the attachment includes an elongated casing 119 as is described herein (the elongated casing 119 attached to the luggage 200).

The handle 100 may include an elongated casing 119 that is shaped, for instance, to be inserted into a cavity of a luggage 200. The handle 100 has two arms 105 (both arms are referred to herein by the numeral 105, wherein numeral 105*a* or 105*b* is used to refer to a specific arm 105) and a gripping segment 104 interconnecting the two arms 105. The arms 105 connect the gripping segment 104 to the elongated casing 119. The handle 100 may also have an actuating mechanism for causing the handle 100 to transition from the retracted position (as shown in FIG. 2A), to the deployed position (as shown in FIG. 2C). In some examples, the actuating mechanism may also be used to actuate the transition between the deployed position to the retracted position. The handle 100 may also have a first lock 124 for locking the handle 100 in the retracted position. The first lock 124 may be connected to an activation trigger (e.g. button) 102 that, once triggered with specific input, such as human input (e.g. is pressed), results in the unlocking of the first lock, permitting the handle 100 to transition from the retracted state to the deployed state. The handle 100 may also have a second lock or locking system 300 (e.g. see FIGS. 3A, 3B, 4 and 5) with an unlocking trigger 103 for causing the locking system 300 to unlock, allowing the handle 100 to transition from a deployed state to a retracted state. In some examples, the handle 100 may have no elongated casing 119, where the components of the handle 100 may be joined directly to the body of luggage 200, such as a cavity defined within a body of the luggage 200.

The elongated casing 119 is an elongated container with at least an upper opening facing the gripping segment 104. The elongated casing 119 has an inner cavity for receiving the arms 105 and the gripping segment 104 defined by the outer walls of the elongated casing 119. In some examples, as shown in FIG. 2A, the arms 105 fit with a head-to-tail configuration in the cavity of the elongated casing 119. As a result, in these examples, the length of the elongated casing 119 is sufficient to receive the length of the first arm and the length of the second arm. The elongated casing 119 may also have a depth sufficient to receive the gripping segment 104, where the upper surface of the gripping segment 104 may arrive flush or nearly flush with the upper edges of the walls of the elongated casing 119 and/or the surface of the body of the luggage into which the handle 110 is retracted. As such, the gripping segment 104 is not protruding or hardly protruding from the elongated casing 119, and not protruding from the luggage 200 when the elongated casing 119 is positioned in the luggage 200. In some embodiments, the gripping segment 104 rests on top of an arm 105, such as arm 105*a*, when retracted into the inner cavity of the elongated casing 119.

In some examples, the elongated casing 119 is made out of a metal such as aluminum or an aluminum alloy. The elongated casing 119 can be made out of a plastic, or another resilient and preferably light material such as a carbon fiber, etc.

The elongated casing 119 may have fastening points 107 (e.g. fastening plates) protruding from sides of the elongated casing 119 for connecting the elongated casing 119 to the luggage 200. Other fastening points, such as the curved extensions acting as fastening points 117, may be provided. A fastener (e.g. such as a screw, bolt, rivet, rod, pin, etc.) may be used, e.g., at the fastening points, to join the elongated casing 119 to the luggage 200. It will be understood that other fasteners may be used to join the elongated casing 119 to the luggage 200 without departing from the present teachings.

As shown in FIG. 2B, the arms 105 are connected to both the gripping segment 104 and the elongated casing 119. The arm 105 may extend out of the inner cavity of the elongated casing 119. In some examples, the arms 105 have the same length.

The connection point between the arm 105 and the gripping segment 104 allows for pivoting of the arm 105 about the rotational axis defined by the connection point between the arm 105 and the gripping segment 104. As such, the connection point between the gripping segment 104 and the arm 105 acts as an articulation.

The connection point between the arm 105 and the elongated casing 119 also allows for pivoting of the arm 105 about the rotational axis defined by the connection point of the arm 105 and the elongated casing 119. The connection point between the elongated casing 119 and the arm 105 acts as an articulation. The rotational axis defined by the connection point between the arm 105 and the gripping segment 104 and the rotational axis defined by the connection point between the arm 105 and the elongated casing 119 may be, in some examples, parallel. The rotational axes defined by the connection points of arm 105*a* (to the gripping segment 104 and the elongated casing 119) may be parallel with the rotation axis defined by the connection points of arm 105*b* (to the gripping segment 104 and the elongated casing 119).

The connector joining one arm 105 to respectively the gripping segment 104, or the elongated casing 119, may be, e.g., a pin or a shaft, providing sufficient freedom to the arm 105 such that the arm 105 may pivot. It will be appreciated that other connectors allowing the arm 105 to pivot about the connection point may be used.

As such, the arms 105 may pivot while the elongated casing 119 remains fixed. This causes the gripping segment 104, connected to both arms 105, to swing.

The gripping segment 104 is the portion of the handle 100 that is gripped by a user. The gripping segment 104 may have an elongated shape such as a cylindrical body, an elongated rectangular prism body, a prism body with a trapezoidal or polygonal cross-section as shown in FIG. 2B, etc., the body of the gripping segment 104 dimensioned to fit into the cavity of the elongated casing 119. In the examples where the gripping segment 104 has edges, such as when it is shaped as a rectangular prism body, the edges of the gripping segment 104 may be rounded so as to not dig into the user's hand when the user is gripping the gripping segment 104.

In some examples, the gripping segment 104 is covered with a fabric, leather, plastic, etc. In other examples, the gripping segment 104 may have a wood finish, be made of metal, etc.

The gripping segment 104 may provide an unlocking trigger 103 configured to unlock the locking mechanism that secures the handle 100 in the deployed state. The unlocking trigger 103 may be a depressible button positioned on the upward surface of the gripping segment 104 (i.e. the surface of the gripping segment 104 facing away from the elongated casing 119). The locking system 300 for the deployed handle 100 is described herein with respect to FIGS. 3A, 3B, 4 and 5.

The gripping segment 104 may have a face plate 115 fastened to an extremity of the gripping segment 104. The face plate 115 may be secured to the face of the gripping segment 104 at its extremity, providing a flat surface that is adapted to abut the inner wall at the extremity of the elongated casing 119 when the gripping segment 104 is retracted into the cavity of the elongated casing 119.

The face plate 115 may have a projection 122 with a fastening point (e.g. a hole) to which is connected an arm 105 (e.g. arm 105*a*). The face plate 115 may be positioned with respect to the gripping segment such that the projection 122 is projecting towards the elongated casing 119. As such, the arm 105*a* may be connected to a lower side of the gripping segment 104, the lower side being the side closest to the elongated casing 119. It will be understood that in some examples where the face plate 115 is not provided, the arm 105*a* may be directly connected to the gripping segment 104, in some examples to the lower side of the gripping segment 104.

In some examples, the arm 105*b* may be connected to an upper side of the gripping segment 104. In some examples, the gripping segment 104 may have joint extensions 123 for connecting with an extension of the arm 105*b*, forming a pivot joint as shown in FIG. 2B. As such, as the arm 105*b* is connected to an upper side of the gripping segment 104, when the handle 100 is fully deployed, an inner surface (surface facing the arm 105*a*) of the arm 105*b* may abut against the neighboring opposing surface of gripping segment 104, the abutment between the gripping segment 104 and the arm 105*b* providing a barrier such that the gripping segment 104 and each of the arms 105 are maintained in an orthogonal position with respect to one another.

Figure 2D:
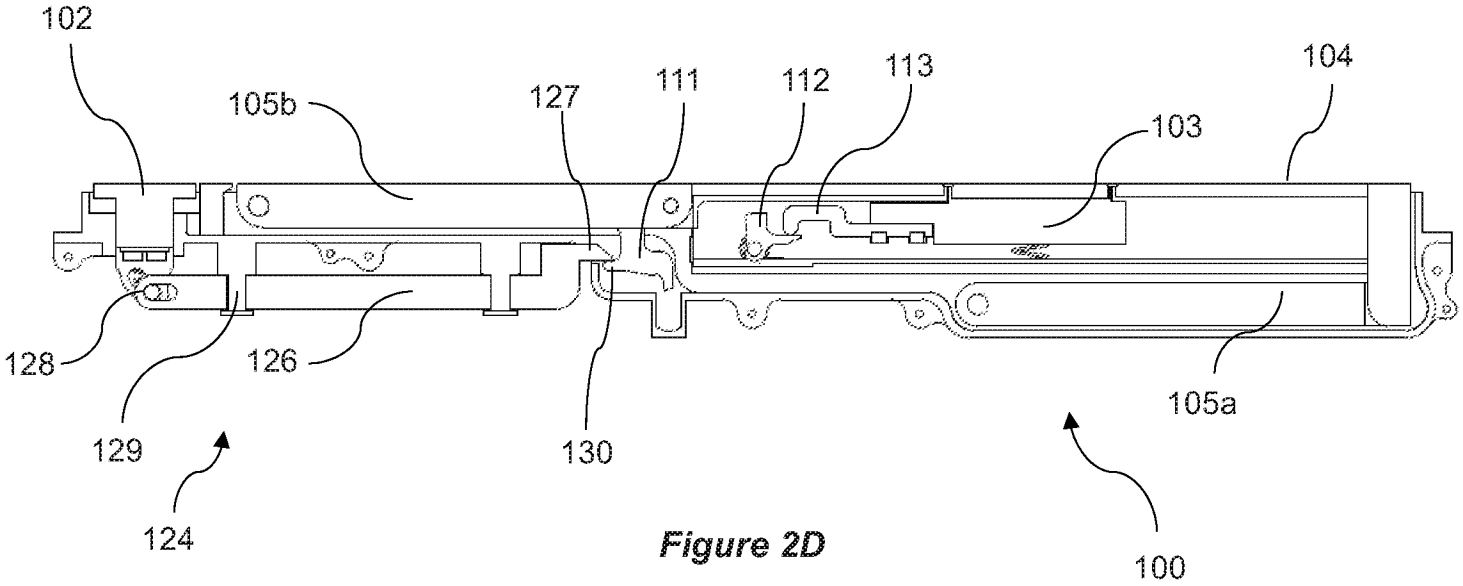
FIG. 2D is a drawing of a cross-sectional side view of an exemplary retractable handle, the retractable handle in a retracted state.

The lock 124 is used to lock the handle 100 when in the retracted state. The lock 124 may be, for example, a latch mechanism, connected to, for instance, a portion of the arm 105*b* as shown in FIG. 2D. For instance, the hook portion 127 of the latch bar 126 may be abutted against a lower curved protrusion 130 of the projection 111. A slidable joint 128 may connect the latch bar 126 and the lower portion of the activation trigger 102. The activation trigger 102 may be a button that, e.g. once pressed by a user, connected to the latch bar 126 via the sliding joint 128, may cause the latch bar 126 to tilt, the activation trigger 102 moving downward as it is pressed, the displacement of the activation trigger 102 causing the proximal end of the latch bar 126 to move downward. The downward motion of the proximal end of the latch bar 126 may cause the distal end of the latch bar 126 to lift, such as a lever, where the lifting of the distal end of the latch 126 may result in the hook portion 127 no longer abutting the lower curved protrusion 130 of the projection 111, releasing the arm 105*b*. This provides sufficient space for the arm 105*b*, and its projection 111, to swing outwards as the arm 105*b* rotates under the torque of, e.g., in the actuation mechanism 10, causing the handle 100 to swing from the retracted state to the deployed state.

In some examples, the lock 124 may have one or more jump staples 129 for guiding and restricting the lever motion of the latch bar 126.

It will be understood that lock 124 may provide other locking mechanisms without departing from the present teachings.

The actuation mechanism 101 is a mechanism that exerts a torque onto at least one of the arms 105 such that the arm rotates, e.g., from the retracted state to the deployed state. In some embodiments, the actuator mechanism 101 is a torsion spring that may be connected to a shaft. The tension of the spring increases when the arms 105 are pushed into the retracted position. The lock 124 prevents the spring from causing the arms 105 to pivot back into the deployed state. When the lock 124 is unlocked, the torque of the torsion spring applied to at least one of the arms (in the example of FIG. 2B, arm 105*a*), causes the arms 105 to pivot back into the deployed position (the lock 124 no longer holding back the arm(s) 105 from rotating under the torque applied by the spring). In some examples, the actuator may be mechanically activated (e.g. a shaft connected to a motor), etc.

In FIG. 2B, the actuator mechanism 101 is shown connected to arm 105*a*. In some embodiments, the actuator mechanism 101 may be connected to arm 105*b*, or both arms 105*a* and 105*b*.

In some embodiments, the handle 100 may have a rail groove 109 formed in a side wall of the elongated casing 119, next to where an arm 105 is connected to the elongated casing 119. A pin 108 may be fixed to the arm 105 that is in proximity to the rail groove 109, the pin fitted through and protruding from the rail groove 109, such that a portion of the pin 118 is located outside the cavity of the elongated casing 119. As the arm 105 pivots, so does the pin 108 move following an arcuate trajectory. The pin 108, running through the rail groove 109, may serve as a guide to better direct and control the movement of the arm 105 and the handle mechanism as it transitions between states. The pin 108 in the rail groove 109 may also restrict the movement of the arm 105 as the pin 108 makes contact with the walls defining the ends of the rail groove 109.

Transition Between the Retracted State and the Deployed State:

In some embodiments, the gripping segment 104, the arms 105 and at least a portion of the elongated casing 119 form a four-bar mechanism, where the movement of the members of the four-bar mechanism do not reach a singularity.

In some examples, the arms 105 move and pivot in parallel, where the gripping segment 104, the arms 105 and at least a portion of the elongated casing 119 form a parallelogram (until the arms 105 and the gripping segment 104 retract and collapse into the inner cavity of the elongated casing 119).

FIG. 2A shows the gripping segment 104 and the arms 105 entirely retracted into the inner cavity of the elongated casing 119. In FIG. 2B, the handle 100 is transitioning between the retracted state and the deployed state. The arms 105 are in parallel, and the arms 105 and at least a portion of the elongated casing 119 form a parallelogram. In FIG. 2C, the handle 100 is deployed. The arms 105 and at least a portion of the elongated casing 119 form a rectangle (e.g., in some examples, a square). As shown in FIG. 2C, in some examples, the upper inner side wall of the arm 105*b* may abut against the adjacent side wall of the gripping segment 104, assisting with the maintaining of the handle 100 in the deployed position where the arms 105 and at least a portion of the elongated casing 119 form a rectangle.

It will be understood that in some examples (not shown), the arms 105 may pivot when transitioning between a deployed state and a retracted state without remaining in parallel. This may be the case in an example where the connection point between each of the arms 105 and the elongated casing 119 is slidable along a length of the elongated casing 119 (such that, when the handle 100 is deployed, the connection points between each of the arms 105 and the elongated casing 119 move closer together, and when the handle 100 is retracted, the connection points between each of the arms 105 and the elongated casing 119 move further apart). The connectors of the arms to the elongated body 119 may be, e.g., on a rail, allowing the connectors to slide along the rail. In this example, the length of the cavity of the elongated casing 119 may be sufficient to accommodate the lengths of the arm 105*a*, the gripping segment 104 and the arm 105*b* placed head to tail. In the configuration when the handle 100 is transitioning between a deployed state and a retracted state, the arms 105 and at least a portion of the elongated casing 119 form a trapezoid.

The Deployed State Locking System (or Latch):

Reference is now made to FIGS. 3A, 3B, 4 and 5 illustrating the different states of a locking system or latch 300 configured, e.g., to secure and maintain a handle in a deployed position. It will be understood that the locking system described herein may be employed in other applications where two segments connected to each other are to be locked in an orthogonal configuration without departing from the present teachings. For the purposes of illustration, the present description makes references to an example where the locking system is used to fix the handle in a deployed state.

The locking system 300 includes a first projection 111 connected to an arm 105. In some examples, the first projection 111 is connected to arm 105*b*.

The locking system 300 includes an unlocking segment 113 that has a length that is parallel to the length of the gripping segment 104. The unlocking segment 113 may be contained within an inner space 120 of the gripping segment 104 (e.g. having a hollow interior with, e.g., an opening on the side facing the elongated casing 119). The locking system 300 also includes an unlocking trigger, such as a depressible unlocking button 103. The unlocking button 103 may be connected to the unlocking segment 113.

In some examples, the locking system 300 may include a lever 112 connected at a pivot point 114 (e.g. a shaft, pin, etc.) to the gripping segment 104. In some embodiments, the lever 112 may be connected to the spring 125 or another mechanism for providing a torque to the lever 112 once the lever 112 is rotated. The spring 125 may be positioned over the pivot point 114. The lever arm may be parallel with the gripping segment 104 when the lever 112 is at rest. Once torque is applied to the lever 112 via, e.g., contact with the projection 111 or the unlocking segment 113, the spring 125 may apply a torque in the opposite direction such that the lever 112 returns to its at rest position when there is no longer a torque applied by the projection 111 or the unlocking segment 113.

The arm 105 and the gripping segment 104 may be connected via a joint 110, the arm 105 and the gripping segment 104 forming an articulation such that the arm 105 may pivot with respect to the gripping segment 104 about the joint 110. The arm 105 and the gripping segment 104 may be connected together using, for example, a pin, a shaft, a rivet, etc.

Figure 5:
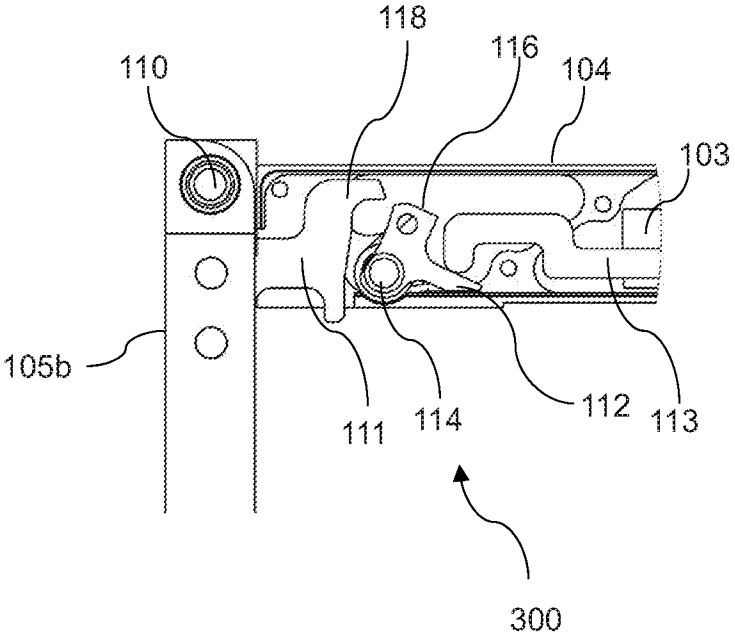
FIG. 5 is a drawing of an exemplary system for locking an exemplary retractable handle in a deployed state, the deployed retractable handle being unlocked as the exemplary unlocking button is being pressed down.

The projection 111 may project away from the arm 105 and end with an upper hook portion having an upper surface 118. The projection 111 is located with respect to the arm 105 such that the upper surface 118 abuts or comes near the upper inner wall of the gripping segment 104 as shown in FIG. 5.

The unlocking trigger 103 may be configured to undergo a translational displacement (e.g. a downward displacement, an upper displacement, etc.), when pressure is applied to the unlocking trigger 103, such as by the pressure exerted by the finger of a user. As the unlocking segment 113 is connected to the unlocking trigger 103, the unlocking trigger 103 similarly undergoes, from its at rest position, the same displacement as the unlocking trigger 103.

The unlocking segment 113, when displaced from its at rest position, causes the arm 105 to be free to pivot, such that the handle 100 is free to transition from a deployed state to a retracted state. In some examples, the unlocking segment may have a surface at its extremity that is adapted to abut with the underside of the hooked portion of the projection 111. The abutting of the underside of the hooked portion of the projection 111 and the surface of the unlocking segment prevents the arm 105, connected to the projection 111, from freely moving. When the unlocking segment 113 undergoes a displacement from its at rest position, so does its surface at its extremity, such that the surface at the extremity of the unlocking segment 113 is no longer abutting the underside of the projection 111. The displacement of the unlocking segment 113 is sufficient to allow the projection 111 to arcuately clear the extremity of the unlocking segment 113, allowing the arm 105 to freely pivot.

In some examples, the unlocking segment 113 is a separate part from the unlocking trigger 103, joined to the unlocking trigger 103 using, e.g., a fastener. In other examples, the unlocking segment 113 may be part of the unlocking trigger 103, where, e.g., the unlocking segment 113 is an extension of the unlocking trigger 103.

In some embodiments where the locking system 300 has a lever 112, the extremity of the unlocking segment 113 may be shaped so as to push down on a lever arm of the lever 112 when the unlocking segment 113 undergoes a displacement from its at rest position. This extremity of the unlocking segment 113 may have a downward angled extremity that presses down on the lever arm of the lever 112.

Figure 4:
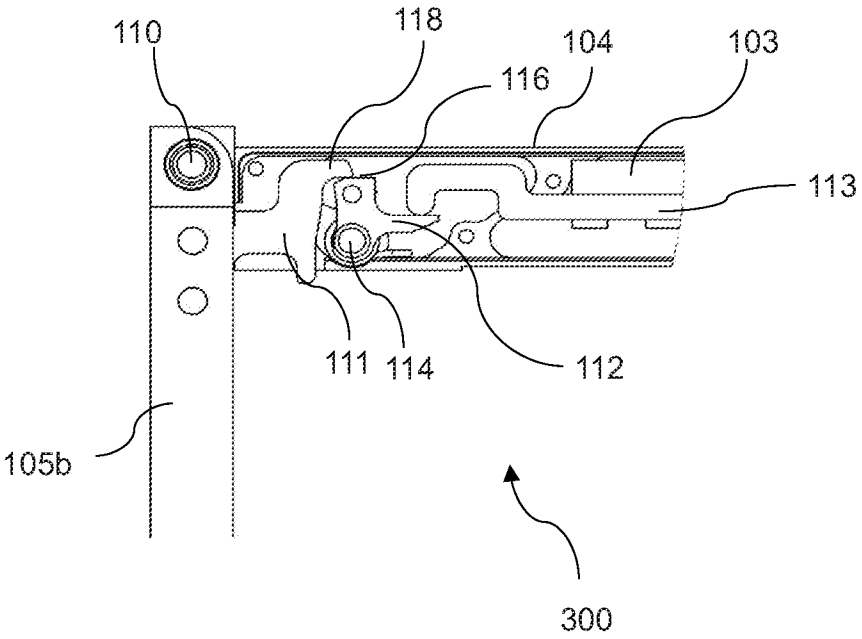
FIG. 4 is a drawing of an exemplary system for locking an exemplary retractable handle in a deployed state, the retractable handle in a locked deployed state.

The lever 112 is positioned so that a side surface can make contact with an end of the projection 111, such as when handle 100 is transitioning from the retracted state to the deployed state. The force exerted by the end of the projection 111 onto the side surface of the projection 111 may cause the lever 112 to rotate, creating a sufficient clearance such that projection 111 may pass, the arm 105 and the projection 111 pivoting such that the handle 100 enters the deployed state. In this state, as shown in FIG. 4, as no pressure is applied on the side surface of the lever 112, the lever 112 returns to its at rest position, its upper receiving surface 116 now parallel with the length of the gripping segment 104 and abutting with an underside of the projection 111. The abutting of the upper receiving surface 116 of the lever 112 with the underside of the projection 111 secures the handle 100 in the deployed position. The locking system 300 locks the handle 100 in the deployed position.

Figure 3B:
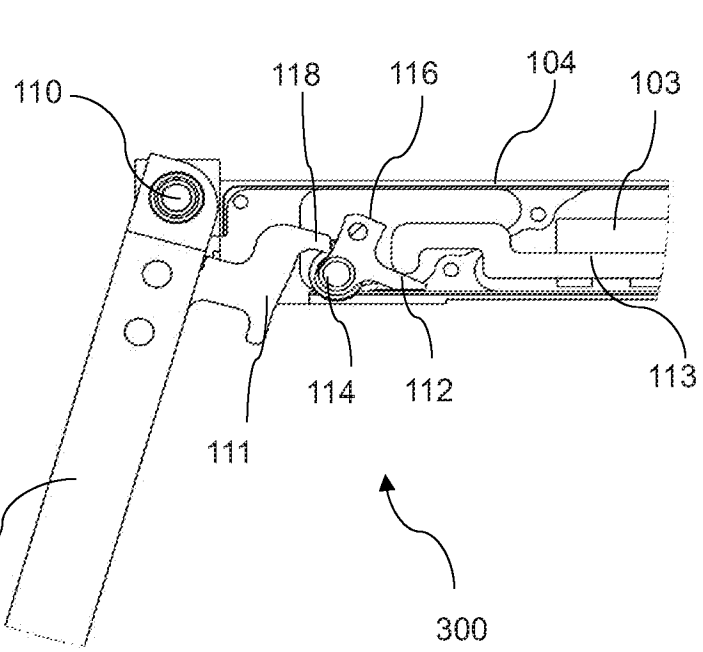
FIG. 3B is a drawing of an exemplary system for locking an exemplary retractable handle in a deployed state, the retractable handle transitioning between a deployed state and a retracted state.
Figure 3A:
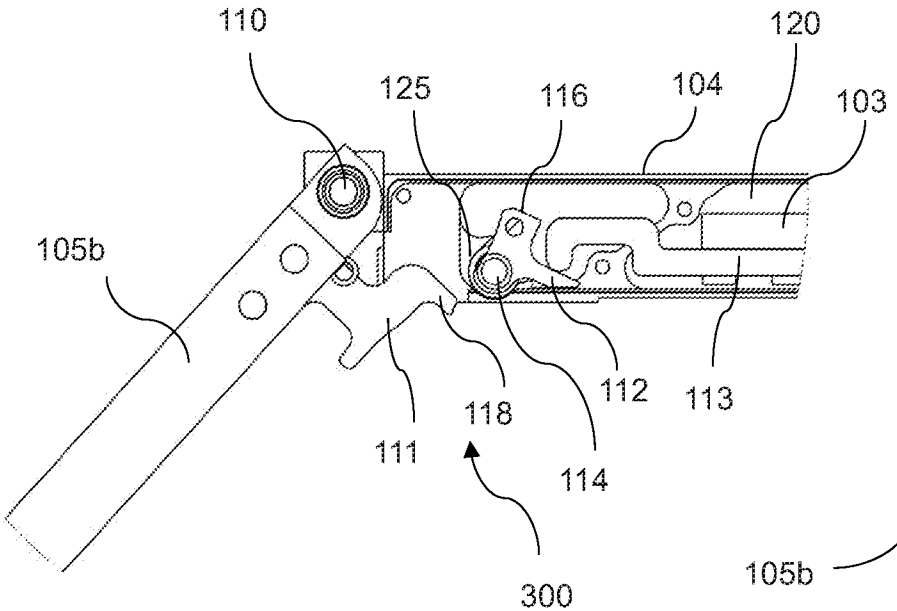
FIG. 3A is a drawing of an exemplary system for locking an exemplary retractable handle in a deployed state, the retractable handle transitioning between a deployed state and a retracted state.

When the unlocking trigger 103 is pressed down as shown in FIG. 5, the pressing down on the lever arm of the lever 112 causes the lever 112 to rotate as shown in FIG. 5 (e.g. as a result of the unlocking segment 113 pressing down on the lever arm of the lever 112). This causes the lever 112 to rotate away from the projection 111, the upper receiving surface 116 of the lever 112 no longer abutting the underside the projection 111. The space created by the rotated lever 112 is sufficient to allow the projection 111 to clear the lever 112 when the arm 105 is pivoted from the deployed state to the retracted state (as shown in FIGS. 3B and 3A). When pressure is no longer applied on the unlocking trigger 103, the unlocking trigger 103 and the unlocking segment 113 return respectively to their position at rest. As a force is no longer applied to the lever arm of the lever 112, the lever 112 returns to its at rest configuration.

Therefore, it will be understood that the projection 111 may have a first engaging portion (e.g. upper surface 118) that participates in the locking of the handle 100 in the deployed state, and a second engaging portion (e.g. lower curved protrusion 130) that participates in the locking in the retracted state.

Figure 6:
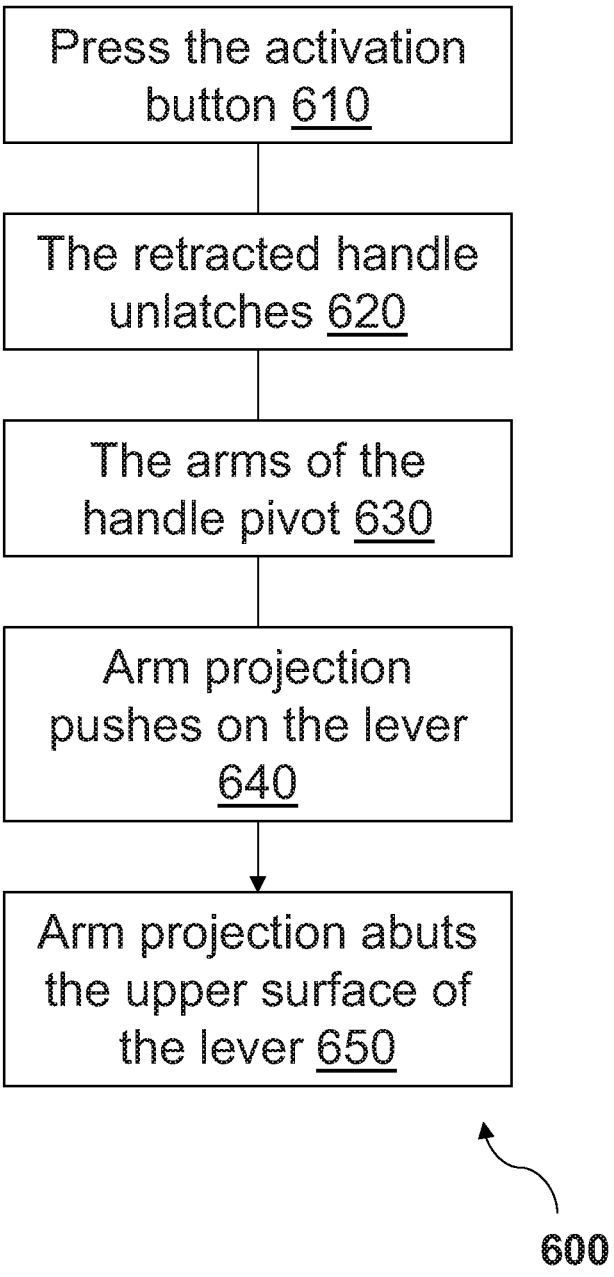
FIG. 6 is a flowchart diagram of an exemplary method of transitioning a retractable handle from a retracted state to a deployed state.

Method of Deploying a Handle and Locking a Handle in a Deployed State:

Reference is now made to FIG. 6, illustrating an exemplary method 600 of deploying a retracted handle and locking the handle in a deployed state.

The handle 100 is first in a retracted position. The retracted handle 100 may be locked via a lock 124 such that the handle 100 is fixed in its retracted state.

An activation trigger may be initiated at step 610 (e.g. such as pressing button 102). This activating of the activation trigger causes the lock 124 to unlock at step 620. As illustrated in FIG. 2D, the lock 124 may provide a latch mechanism similar to a Suffolk latch, where pressing of an activation trigger (e.g. button) 102 causes a proximal end of a latch arm 126 to descend, resulting in the distal end rising. The rising of the distal end causes the latch bar 126 to disengage an abutment of the arm 105 or that is attached to the arm 105 (e.g. the lower curved protrusion 130).

In its unlocked state, the handle 100 is free to transition from its retracted state to its deployed state. This is carried out by the pivoting of the arms 105 such that the arms 105 rise from the inner cavity of the elongated body at step 630. The pivoting of the arms 105 may be the result of manual force, where a user, e.g., exerts a torque by pressing onto the gripping segment 104, the arms 105 pivoting in suit. In some examples, the pivoting of the arms 105 may be caused by the application of a torque onto at least one of the arms 105 by, e.g., an actuation mechanism (e.g. composed of a motor; a torsion spring; etc.).

As the arms 105 approach the deployed state, the projection 111 of the arm 105 may press on the side surface of a lever 112 at step 640, causing the lever 112 to rotate as a result of the application of the force. The rotated lever 112 creates sufficient space to allow the projection 111 to clear the lever 112.

With no longer any force exerted on the side surface of the lever 112, the lever 112 returns to its state at rest. The projection 111, now with an upper surface 118 abutting or near the upper inner wall of the gripping segment 104 (walls of the gripping segment 104 defining an inner cavity 120), may have an underside that abuts the upper receiving surface 116 of the lever 112 at step 650. The handle is in its deployed state, and, in some examples, the abutment between the upper receiving surface 116 of the lever 112 and the underside of the projection 111 may fix the handle 100 in its deployed state.

Figure 7:
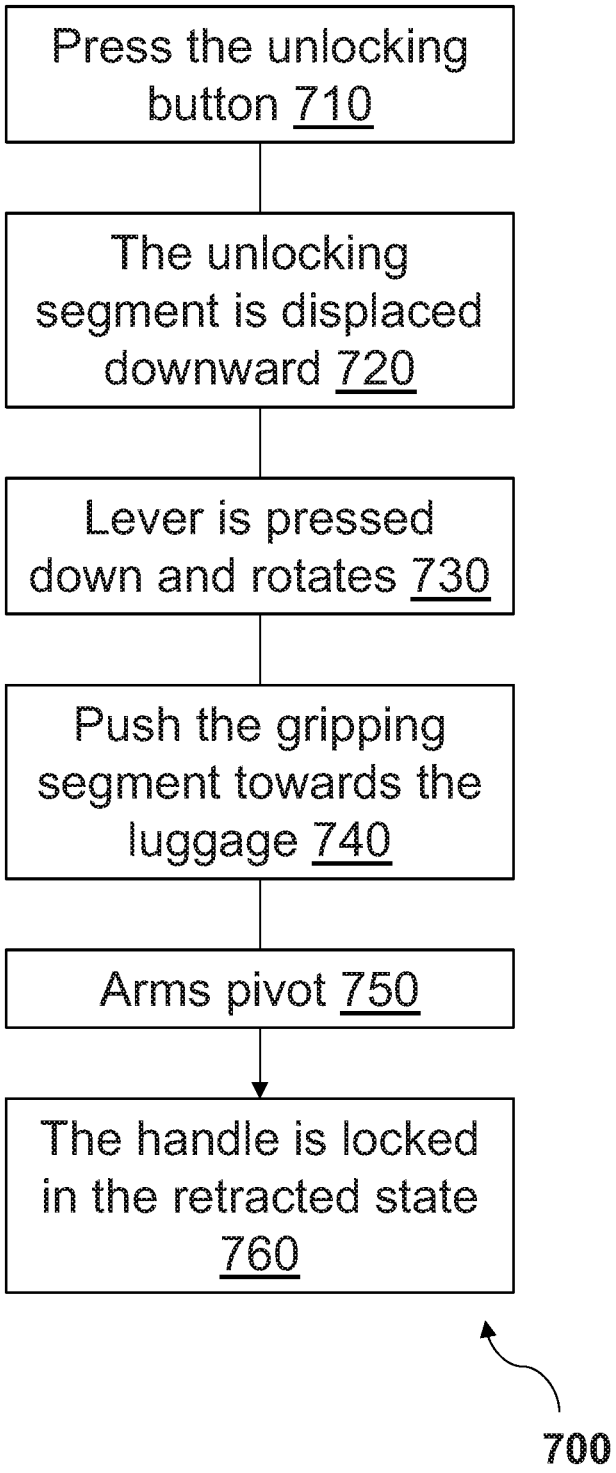
FIG. 7 is a flowchart diagram of an exemplary method of transitioning an=retractable handle from a deployed state to a retracted state.

Method of Unlocking a Deployed Handle and Locking the Handle in a Retracted State:

Reference is now made to FIG. 7, illustrating an exemplary method 700 of unlocking a deployed handle, retracting the handle, and locking the handled in a retracted state.

The unlocking trigger 103 (e.g. button) may be pressed at step 710. The pressing of the unlocking trigger 103 may cause the unlocking trigger 103 to undergo a displacement from its at rest position (i.e. when no force is exerted on the unlocking trigger 103). In some examples, the activation of the unlocking trigger 103 may not result in its displacement, but instead results in causing the unlocking segment 113 to undergo a displacement (e.g. via a motor actuatable by the unlocking trigger 103).

The displacement of the unlocking trigger 103 may cause the unlocking segment 113 to undergo a similar displacement at step 720. In some examples, this may be a downward displacement, or a displacement towards the elongated casing 119.

In some embodiments, the displacement of the unlocking segment 113 may press downward onto a lever arm of a lever 112, causing the lever 112 to rotate towards the unlocking segment 113 at step 730. The rotating of the lever 112 may result in the upper receiving surface 116 of the lever 112 no longer abutting the underside of the projection 111, creating sufficient space to allow the projection 111 of the arm 105 to clear the lever 112.

While the unlocking trigger 103 is still activated, a user may press downward onto the gripping segment 104, pushing towards the inner cavity of the elongated casing 119 at step 740. It will be understood that in some embodiments, once the unlocking trigger 103 is activated, a mechanism (e.g. a motor, spring, etc.) may be used to drive the handle 100 from its deployed state to its retracted state without a user having to manually apply a force. The applied force or torque (e.g. from a user, or from a mechanism) results in the arms 105 and the gripping segment 104 swinging towards the elongated casing 119, and the arms 105 pivot towards the elongate body 119 at step 750.

Once the arms 105, and the gripping segment 104, have retreated into the inner cavity of the elongated casing 119, the lock 124 fix the arm 105 and the handle in the retracted position. For instance, the lock 124 may include a latch mechanism, e.g. secured to the lower curved portion 130 of projection 111, as described herein, and/or as illustrated in FIG. 2D securing the handle 100 in the retracted state.

Although the invention has been described with reference to preferred embodiments, it is to be understood that modifications may be resorted to as will be apparent to those skilled in the art. Such modifications and variations are to be considered within the purview and scope of the present invention.

Representative, non-limiting examples of the present invention were described above in detail with reference to the attached drawing. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings.

Moreover, combinations of features and steps disclosed in the above detailed description, as well as in the experimental examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

What is claimed is:

1. A retractable handle comprising:

a first arm comprising a first end and a second end and a second arm comprising a first end and a second end;

a gripping segment that interconnects said first arm at said first end of said first arm at a first gripping attachment point and said second arm at said first end of said second arm at a second gripping attachment point, wherein said first arm is attached to said gripping segment such that said first arm can rotate about the first gripping attachment point of said first arm to said gripping segment, and wherein said second arm is attached to said gripping segment such that said second arm can rotate about the second gripping attachment point of said second arm to said gripping segment; and an attachment for securing said handle to a luggage body;

wherein said handle, through rotary motion of said first arm and said second arm, is adapted to transition between a deployed state and a retracted state, wherein a length of said first arm, a length of said second arm and a length of said gripping segment are parallel in said retracted state, and wherein said length of said first arm is parallel to said length of said second arm in said deployed state, and said length of said first arm is orthogonal to said length of said gripping segment in said deployed state; and a latch configured to secure said handle in said retracted state and a latch configured to secure said handle in said deployed state, said first arm comprising a projection protruding towards said second arm when said length of said first arm is parallel with said length of said second arm, wherein said latch configured to secure said handle in said retracted state is configured to engage with said projection to secure said handle in said retracted state, and wherein said latch configured to secure said handle in said deployed state is configured to engage with said projection to secure said handle in said deployed state.

2. The handle as defined in claim 1, wherein said attachment comprises an elongated casing to which is connected said second end of said first arm at a first casing attachment point and said second end of said second arm at a second casing attachment point, said casing comprising a cavity with a length sufficient to receive both said length of said first arm and said length of said second arm, said cavity further adapted to receive said gripping segment, said elongated casing attachable to said luggage body, wherein said first arm is configured to undergo rotary motion about said first casing attachment point and said second arm is configured to undergo rotary motion about said second casing attachment point, and wherein said gripping segment, said first arm and said second arm are retractable into said cavity by the rotating of said first arm and said second arm, and said first arm and said second arm are deployable from said cavity by the rotating of said first arm and said second arm.

3. The handle as defined in claim 1, wherein said first arm and said second arm are configured to maintain a parallel configuration when rotating.

4. The handle as defined in claim 1, wherein said first arm is attached to a first end of said gripping segment at a top portion of said gripping segment, and said second arm is attached to a second end of said gripping segment at a bottom portion of said gripping segment, said first end of said first arm providing an abutting surface configured to abut with a side surface of said gripping segment facing said abutting surface of said first arm when said handle is deployed.

5. The handle as defined in claim 4, wherein said gripping segment comprises at said second end a flat-faced end plate fixed to said second arm.

6. The handle as defined in claim 1, wherein said rotating of said first arm and said second arm is driven by an actuator comprising a shaft that is connected to said second end of said first arm.

7. The handle as defined in claim 6, wherein said actuator is a torsion spring mechanism.

8. The handle as defined in claim 2, wherein said elongated casing comprises a rail groove positioned next to one of said first casing attachment point and said second casing attachment point, said rail groove shaped to receive a pin connected to one of said first arm and said second arm, said pin travelling through said rail groove as said handle transitions between being retracted and being deployed, said pin abutting the ends of said rail groove in order to control the magnitude of movement of said first and said second arm when transitioning between said retracted state and said deployed state.

9. The handle as defined in claim 1, wherein said latch configured to secure said handle in said deployed state comprises:

a depressible button;

an unlocking segment connected to said depressible button that undergoes a downward displacement when said depressible button is depressed; and a lever that is configured to rotate when said unlocking segment presses down on an arm of said lever as said unlocking segment undergoes said downward displacement, said lever further configured to engage with said projection to secure said handle in said deployed state, and wherein rotating of said lever results in said lever disengaging with said projection.

10. The handle as defined in claim 1, wherein said gripping segment comprises a prism body and the rectangular faces of said prism body comprises rounded edges.

11. The handle as defined in claim 1, wherein said gripping segment rests on top of said second arm when said handle is in said retracted state.

12. Luggage comprising a handle as defined in claim 1.

* * * * *